US006600893B2

(12) United States Patent
Ashibe et al.

(10) Patent No.: US 6,600,893 B2
(45) Date of Patent: Jul. 29, 2003

(54) TRANSFER MEMBER, PROCESS FOR PRODUCING TRANSFER MEMBER, AND IMAGE FORMING APPARATUS HAVING TRANSFER MEMBER

(75) Inventors: Tsunenori Ashibe, Kanagawa (JP); Hiroyuki Kobayashi, Shizuoka (JP); Akihiko Nakazawa, Shizuoka (JP); Atsushi Tanaka, Shizuoka (JP); Takashi Kusaba, Shizuoka (JP); Hidekazu Matsuda, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/954,068

(22) Filed: Sep. 18, 2001

(65) Prior Publication Data

US 2002/0061210 A1 May 23, 2002

(30) Foreign Application Priority Data

Sep. 19, 2000 (JP) ..... 2000-284095
Feb. 28, 2001 (JP) ..... 2001-054775

(51) Int. Cl.[7] ..... G03G 15/16
(52) U.S. Cl. ..... 399/302; 430/126

(58) Field of Search ..... 399/302, 308; 430/126

(56) References Cited

U.S. PATENT DOCUMENTS

| | | | | |
|---|---|---|---|---|
| 5,256,512 A | | 10/1993 | Kobayashi et al. | 430/106 |
| 5,873,018 A | * | 2/1999 | Aoto et al. | 399/302 |
| 6,094,556 A | | 7/2000 | Tanaka et al. | 399/302 |

FOREIGN PATENT DOCUMENTS

| | | |
|---|---|---|
| JP | 63-301960 | 12/1988 |
| JP | 1-309083 | 12/1989 |

* cited by examiner

*Primary Examiner*—Hoang Ngo
(74) *Attorney, Agent, or Firm*—Fitzpatrick, Cella, Harper & Scinto

(57) ABSTRACT

In a transfer belt having a thickness from 45 to 300 μm having at least a resin layer, the resin layer contains a thermoplastic resin and a polyether-ester amide, and the thermoplastic resin and the polyether-ester amide are in a weight ratio of from 79:21 to 60:40. Also provided are a process for producing the transfer member and an image-forming apparatus having the transfer member.

10 Claims, 3 Drawing Sheets

TRANSFER MEMBER, PROCESS FOR PRODUCING TRANSFER MEMBER, AND IMAGE FORMING APPARATUS HAVING TRANSFER MEMBER

BACKGROUND OF THE INVENTION

1. Field of the Invention

This invention relates to a transfer member, a process for producing the transfer member, and an image-forming apparatus having the transfer member.

2. Related Background Art

Image-forming apparatus making use of an intermediate transfer member which is one of transfer members are effective as full-color image-forming apparatus or multi-color image-forming apparatus in which a plurality of component color images corresponding to full-color image information or multi-color image information are sequentially superimposingly transferred to output image-formed articles on which full-color images or multi-color images have synthetically been reproduced, or as image-forming apparatus made to have the function of full-color image formation or the function of multi-color image formation.

An example of an image forming apparatus employing an intermediate transfer belt which is a belt-form transfer member is schematically shown in FIG. 1.

The apparatus shown in FIG. 1 is a full-color image-forming apparatus (copying machine or laser beam printer) utilizing an electrophotographic process. A medium-resistance elastic material is used in an intermediate transfer belt 20.

Reference numeral 1 denotes a drum-shaped electrophotographic photosensitive member repeatedly used as a first image bearing member (latent-image-bearing member), which is rotatingly driven at a prescribed peripheral speed (process speed) in the direction of an arrow.

The photosensitive drum 1 is, in the course of its rotation, uniformly charged to prescribed polarity and potential by means of a primary charging assembly 2, and then image-wise exposed to light 3 by an exposure means (e.g., a color-original image color-separating/image-forming optical system, or a scanning exposure system comprising a laser scanner that outputs laser beams modulated in accordance with time-sequential electrical digital pixel signals of image information). Thus, an electrostatic latent image is formed which corresponds to a first color component image (e.g., a yellow color component image) of the intended color image.

Next, the electrostatic latent image formed is developed with a first-color yellow toner Y by means of a first developing assembly (yellow color developing assembly 41). At this stage, second to fourth developing assemblies (magenta color developing assembly 42, cyan color developing assembly 43 and black color developing assembly 44) each stand unoperated and do not act on the electrophotographic photosensitive member 1, and hence the first-color yellow toner image is not affected by the second to fourth developing assemblies.

The intermediate transfer belt 20 is clockwise rotatingly driven at the same peripheral speed as the electrophotographic photosensitive member 1.

The first-color yellow toner image formed and held on the electrophotographic photosensitive member 1 passes a nip formed between the electrophotographic photosensitive member 1 and the intermediate transfer belt 20, in the course of which it is successively intermediately transferred to the periphery of the intermediate transfer belt 20 (primary transfer) by the aid of an electric field formed by a primary transfer bias applied to the intermediate transfer belt 20 through a primary transfer roller 62.

The electrophotographic photosensitive member 1 surface from which the first-color yellow toner image has been transferred to the intermediate transfer belt 20, is cleaned by a cleaning assembly 13.

Subsequently, the second-color magenta toner image, the third-color magenta toner image and the fourth-color black toner image are sequentially similarly transferred superimposingly onto the intermediate transfer belt 20. Thus, synthesized color toner images corresponding to the intended full-color image is formed.

Reference numeral 63 denotes a secondary transfer roller, which is provided in such a way that it is axially supported in parallel to a secondary transfer opposing roller 64 and stands separable from the bottom surface of the intermediate transfer belt 20.

The primary transfer bias for sequentially superimposingly transferring the first- to fourth-color toner images from the electrophotographic photosensitive member 1 to the intermediate transfer belt 20 is applied from a bias source 29 in a polarity (+) reverse to that of each toner. The voltage thus applied is, e.g., in the range of from +100 V to +2 kV.

In the step of primary transfer of the first- to third-color toner images from the electrophotographic photosensitive member 1 to the intermediate transfer belt 20, the secondary transfer roller 63 may also be set separable from the intermediate transfer belt 20.

The synthesized color toner images transferred to the intermediate transfer belt 20 are transferred to a second image bearing member, transfer medium P, in the following way: The secondary transfer roller 63 is brought into contact with the intermediate transfer belt 20 and simultaneously the transfer medium P is fed at a prescribed timing from a paper feed roller 11 through a transfer medium guide 10 until it reaches a contact nip formed between the intermediate transfer belt 20 and the secondary transfer roller 63, where a secondary transfer bias is applied to the secondary transfer roller 63 from a power source 28. On account of this secondary transfer bias, the synthesized color toner images are transferred from the intermediate transfer belt 20 to the second image bearing member transfer medium P (secondary transfer). The transfer medium P to which the toner images have been transferred are guided into a fixing assembly 15 and are heat-fixed there.

After the toner images have been transferred to the transfer medium P, a charging member 7 for cleaning is brought into contact with the intermediate transfer belt 20, and a bias with a polarity reverse to that of the electrophotographic photosensitive member 1 is applied, whereupon electric charges with a polarity reverse to that of the electrophotographic photosensitive member 1 are imparted to toners not transferred to the transfer medium P and remaining on the intermediate transfer belt 20 (i.e., transfer residual toners). Reference numeral 26 denotes a bias power source.

The transfer residual toners are electrostatically transferred to the electrophotographic photosensitive member 1 at the nip between the electrophotographic photosensitive member 1 and the intermediate transfer belt 20 and the vicinity thereof, thus they are removed from the intermediate transfer belt 20.

Compared with a prior art transfer unit in which toner images are transferred from a first image bearing member to a second image bearing member (transfer medium) fastened or attracted onto a transfer drum as disclosed in, e.g., Japanese Patent Application Laid-open No. 63-301960, full-color electrophotographic apparatus having an image-forming apparatus making use of the intermediate transfer member described above have an advantage that a variety of second image bearing member transfer mediums can be selected without regard to their width and length, including thin paper (40 g/m$^2$ paper) and up to thick paper (200 g/m$^2$ paper) such as envelopes, post cards and labels. This is because any processing or control (e.g., the transfer material is held with a gripper, attracted, and made to have a curvature) is not required for the second image bearing member transfer material.

Because of such advantages, full-color copying machines and full-color printers making use of intermediate transfer belts have already begun to be available in the market.

An example of an image-forming apparatus employing a belt-form transfer-transport belt as a transfer-transport (image-transferring and paper-transporting) member which is one of transfer members is schematically shown below in FIG. 2.

The image forming apparatus shown in FIG. 2 is, as one type of a full-color image-forming apparatus of color-separated image superimposing transfer system, an apparatus in which different color toner images are respectively formed on a plurality of photosensitive members, and the toner images on the respective photosensitive members are transferred, under registration, to a single sheet of transfer medium transported in sequential contact with the respective photosensitive members, thus a full-color image is obtained.

The image forming apparatus shown in FIG. 2 comprises, as electrophotographic processing means, four image forming sections I, II, III and IV arranged side by side at the upper part of an apparatus main body 320. The image forming sections I, II, III and IV are respectively constituted of electrophotographic photosensitive members 301Y, 301M, 301C and 301BK as image bearing members, primary charging rollers 302Y, 302M, 302C and 302BK as primary charging assemblies, exposure units 303Y, 303M, 303C and 303BK, developing assemblies 304Y, 304M, 304C and 304BK, and cleaners 305Y, 305M, 305C and 305BK. The developing assemblies 304Y, 304M, 304C and 304BK hold a yellow (Y) toner, a magenta (M) toner, a cyan (C) toner and a black (BK) toner, respectively.

A transfer assembly 310 is also provided at the lower part of the image forming sections I to IV. The transfer assembly 310 is constituted of an endless transfer-transport belt 314 provided stretchingly across a drive roller 311, a follower roller 312 and a tension roller 313, and transfer charging assemblies 315Y, 315M, 315C and 315BK provided opposingly to the electrophotographic photosensitive members 301Y, 301M, 301C and 301BK of the image forming sections I, II, III and IV, respectively.

Meanwhile, at the bottom of the apparatus main body 320, a cassette 306 is provided in which a multiple sheet of transfer mediums (recording paper) P can superposingly be held as recording mediums. The transfer mediums P held in the cassette 306 are sheet by sheet sent out by a paper feed roller 307, and are transported to a registration roller 309 through a transport guide 308.

A separation charging assembly 316 and a fixing assembly 317 are provided on the downstream side in the transport direction of the transfer medium P in the apparatus main body 320, and a paper output tray 318 is installed on the outside of the apparatus main body 320.

In the image forming sections I, II, III and IV, the electrophotographic photosensitive members 301Y, 301M, 301C and 301BK are rotatingly driven at a prescribed speed in the direction of an arrow shown in the drawing, and these are uniformly electrostatically charged by means of the primary charging rollers 302Y, 302M, 302C and 302BK, respectively. The electrophotographic photosensitive members 301Y, 301M, 301C and 301BK thus charged are exposed to light by means of the exposure units 303Y, 303M, 303C and 303BK, respectively, in accordance with image information, whereupon electrostatic latent images are formed on the respective electrophotographic photosensitive members 301Y, 301M, 301C and 301BK. The electrostatic latent images are developed by means of the developing assemblies 304Y, 304M, 304C and 304BK to become visible images as a yellow toner image, a magenta toner image, a cyan toner image and a black toner image, respectively.

Meanwhile, the transfer medium P transported from the cassette 306 to the registration roller 309 through the transport guide 308 is sent out to the transfer assembly 310 by the registration roller 309 under timing, and is then attracted to the transfer-transport belt 314 and passed through the respective image forming sections I, II, III and IV together with the belt, in the course of which the yellow toner image, the magenta toner image, the cyan toner image and the black toner image are superimposingly transferred to the transfer medium P by the operation of the transfer charging assemblies 315Y, 315M, 315C and 315BK, respectively.

Then, the transfer medium P to which the color toner images have been transferred as described above is destaticized by the separation charging assembly 316 to become separated from the transfer-transport belt 314, and thereafter transported to the fixing assembly 317, where the color toner images are heat-fixed to form a full-color image. The transfer medium P with the full-color image is finally put out of the apparatus main body 320, and laid on the paper output tray 318.

The full-color image-forming apparatus employing the transfer-transport belt described above has an advantage that images can be reproduced in a short time because the respective color images are superimposingly transferred while the transfer medium is sequentially transported to the respective image-forming sections.

Because of such an advantage, full-color copying machines and full-color printers making use of transfer-transport belts have already begun to be available in the market.

However, have these full-color image-forming apparatus employing such an intermediate transfer belt or transfer-transport belt functioned as apparatus which well make the most of the above advantages and afforded true expectations, and also given satisfaction, to users? The answer is "No". In providing the full-color image-forming apparatus employing such an intermediate transfer belt or transfer-transport belt, problems to be overcome as stated below are still unsettled.

In the preparation of intermediate transfer belt or transfer-transport belt, a polyether-ester amide is mixed in a thermoplastic resin in some cases so as to endow the belt with an appropriate electrical resistivity. It, however, has been found that, as seen from Japanese Patent Publication No. 8-7505, when it is mixed in a proportion of 20% by weight or less, a fine unevenness in conductivity due to the island-in-sea structure which is a mechanism by which the polyether-ester amide exhibits conductivity may occur to cause fine image unevenness (the fine image unevenness herein referred to is meant to be a condition in which any unevenness is not recognizable on high-density line images such as character prints but minute streaky unevenness is recognizable on images having an intermediate tone and large area such as halftone images). More specifically, if the polyether-ester amide is less than 20% by weight, dispersion of the polyether-ester amide (islands) in the thermoplastic resin (sea) may stand coarse, so that the spaces may be produced so greatly that portions having a conductivity (i.e., portions comprised only of the polyether-ester amide) and portions having no conductivity (i.e., portions comprised only of the thermoplastic resin) appear on images in some cases. This has often made it difficult to obtain products which are satisfactory on images.

SUMMARY OF THE INVENTION

An object of the present invention is to provide a high-quality intermediate transfer member and transfer member which may cause no faulty images when toner images are transferred from the first image-bearing member to the intermediate transfer member and transferred from the intermediate transfer member to the second image-bearing member, or when transferred from the first image-bearing member to the second image-bearing member.

To achieve the above object, the present invention provides a transfer member having at least a resin layer, wherein the resin layer contains a thermoplastic resin and a polyether-ester amide, and the thermoplastic resin and the polyether-ester amide are in a weight ratio of from 79:21 to 60:40.

The present invention also provides a process for producing a belt-form transfer member, wherein a material containing a thermoplastic resin and a polyether-ester amide, the thermoplastic resin and the polyether-ester amide being in a weight ratio of from 79:21 to 60:40, is extruded from a circular die to form a tube, and then the tube is cut to obtain a seamless belt.

The present invention still also provides an image-forming apparatus having the above transfer member.

DESCRIPTION OF THE PREFERRED EMBODIMENTS

Figure 1:
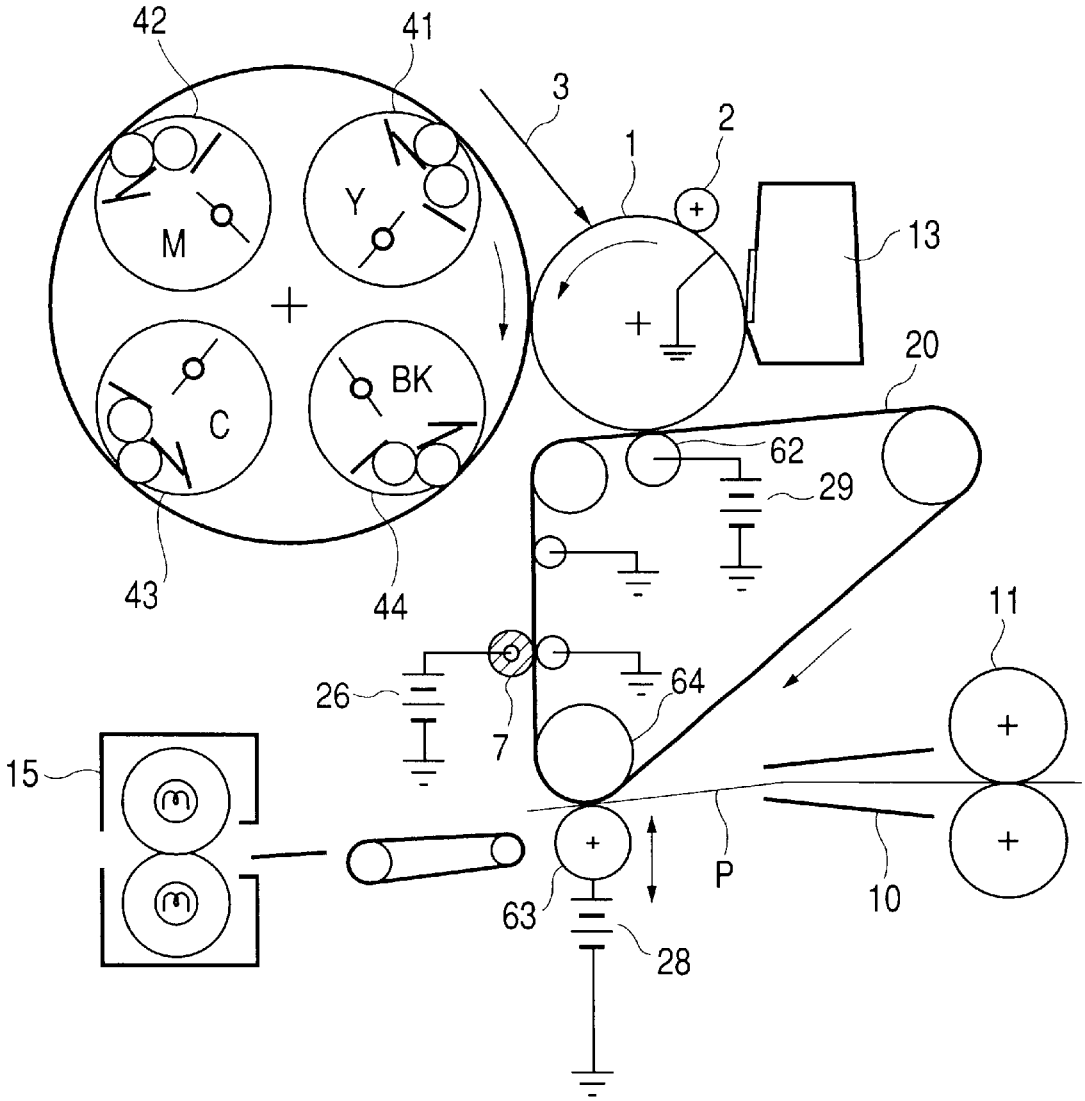
FIG. 1 is a schematic view of an example of an image-forming apparatus employing an intermediate transfer member.

The transfer member of the present invention has a resin layer containing a thermoplastic resin and a polyether-ester amide in a weight ratio of from 79:21 to 60:40. This brings the dispersion of the polyether-ester amide in the thermoplastic resin into a dense state, so that the spaces can be so small that portions having a conductivity (i.e., portions comprised only of the polyether-ester amide) and portions having no conductivity (i.e., portions comprised only of the thermoplastic resin) do not appear on images, and good images not having any fine image unevenness can be obtained.

If the thermoplastic resin and the polyether-ester amide are in a weight ratio lower than 60:40, although the fine image unevenness does not occur, the transfer member may have too low a resistance to apply a transfer electric field with ease.

Where the transfer member such as the intermediate transfer member or the transfer-transport member should be improved in mechanical properties, it is preferable to blend two or more types of polyether-ester amides having different melt viscosities. This is because the blending of a polyether-ester amide having a low melt viscosity with a polyether-ester amide having a high melt viscosity enables fine dispersion of the polyether-ester amide having a low melt viscosity, to bring the spaces between the polyether-ester amide portions into a denser state, so that the fine image unevenness can be prevented, and also because the polyether-ester amide having a high melt viscosity is finely dispersed with difficulty and hence the polyether-ester amide portions form a network with each other to allow the resin portions to connect with each other, bringing about an improvement in mechanical properties.

In the present invention, the melt viscosity is measured in the following way.

Measuring Instrument

Flow tester CFT-500D, manufactured by Shimadzu Corporation.

Sample

A sample made to have a small diameter like pellets or powder is used so that it can be put into a cylinder.

Measurement Conditions

Orifice area×length: 1 $mm^2$×1 mm.

Measurement mode: The heat-up method.

In the results obtained by the measurement carried out under the above conditions, the temperature judged as the value of melt viscosity in the present invention is the temperature at the time of the kneading of the thermoplastic resin and the polyether-ester amide. For example, when a screw type kneader such as a twin-screw extruder is used, it refers to the maximum value of barrel temperature. In the present invention, it is important for the material to have a different melt viscosity at the time of kneading, and hence changes in viscosity of the polyether-ester amide can be known by the measurement made by the above heat-up method. Thus, the above conditions are preferred because optimum conditions can be found with ease.

Where the intermediate transfer member and the transfer-transport member should be made stable in resistance, it is preferable to blend two or more types of polyether-ester amides having different volume resistivities. This is because the blending of only a polyether-ester amide having a low resistance tends to cause a change in conductivity in its addition in a small quantity. Accordingly, where the resistance should be well controlled, a polyether-ester amide having a low resistance and one having a high resistance are blended so that the transfer member is made to have a conductivity close to the desired conductivity by the addition of the polyether-ester amide having a low resistance and then the polyether-ester amide having a high resistance is blended to make the transfer member finally have the necessary conductivity, whereby the tolerance for measurement can be set in a wide range. Also, the respective polyether-ester amides may preferably have the difference in volume resistivity by at least one figure.

The electrical resistance of the transfer member of the present invention is measured in the following way.

Measuring Instrument

Resistance meter: Ultra-high resistance meter R8340A (manufactured by Advantest Co.)

Sample box: Sample box TR42 for ultra-high resistance measurement (manufactured by Advantest Co.)

Here, the main electrode is 25 mm in diameter, and the guard-ring electrode is set to be 41 mm in inner diameter and 49 mm in outer diameter.

Sample

An intermediate transfer belt is cut in a circular form of 56 mm in diameter. After cutting, it is provided, on its one side, with an electrode over the whole surface by forming a Pt—Pd deposited film and, on the other side, provided with a main electrode of 25 mm in diameter and a guard electrode of 38 mm in inner diameter and 50 mm in outer diameter by forming Pt—Pd deposited films. The Pt—Pd deposited films are formed by carrying out vacuum deposition for 2 minutes using Mild Sputter E1030 (manufactured by Hitachi Ltd.). The one on which the vacuum deposition has been carried out is used as the sample for measurement.

Measurement Conditions

Measurement atmosphere: 23° C., 55% RH. The measuring sample is previously kept left in an atmosphere of 23° C. and 55% RH for 12 hours or longer.

Measurement mode: Program mode 5 (discharge for 10 seconds, charge and measurement for 30 seconds)

Applied voltage: 1 to 1,000 V

The applied voltage may arbitrarily be selected within the range of from 1 to 1,000 V which is part of the range of the voltage applied to the intermediate transfer member and transfer member used in the image-forming apparatus of the present invention. Also, the applied voltage used may appropriately be changed within the above range of applied voltage in accordance with the resistance value, thickness and breakdown strength of the sample.

In the present invention, the polyether-ester amide is meant to be a compound composed chiefly of a copolymer consisting of a polyamide block unit such as nylon 6, nylon 66, nylon 11 or nylon 12 and a polyether-ester unit. For example, it may include copolymers derived from lactams, salts of lactams, aminocarboxylic acids or salts of amino carboxylic acids, and polyethylene glycol and dicarboxylic acids (e.g., terephthalic acid, isophthalic acid and adipic acid).

What is meant by "composed chiefly of" is a state in which the copolymer is present in an amount of at least 50% in weight ratio.

The polyether-ester amide may be produced by a known polymerization process.

The thermoplastic resin used in the present invention may include thermoplastic resins such as low-density polyethylene, straight-chain low-density polyethylene, high-density polyethylene, polypropylene (including homopolymers, block copolymers and random copolymers), polyethylene terephthalate, polybutylene terephthalate, polycarbonate, polyvinyl chloride, polystyrene, methacrylate resin, polyimide, polyamide-imide, polyether-imide, polyvinylidene chloride, ethylene/vinyl acetate copolymer, ionomer resins, ethylene/ethyl acrylate copolymer resin, acrylonitrile/acrylic rubber/styrene copolymer resin, acrylonitrile/styrene copolymer resin, acrylonitrile/chlorinated polyethylene/styrene copolymer resin, acrylonitrile/butadiene/styrene copolymer resin, chlorinated polyethylene, polyacetal resin, polyoxybenzoyl resin, polyether ether ketone resin, polysulfone resin, polyphenylene ether resin, polyphenylene sulfide resin, polybutadiene resin, methylpentene resin, polyvinylidene fluoride, tetrafluoroethylene/ethylene copolymer resin, tetrafluoroethylene/hexafluoropropylene copolymer resin, ethylene/chlorotrifluoethylene copolymer resin, and thermoplastic elastomers of various types. Examples are not limited to these since the degree of volume resistivity is a relative value to the end.

The transfer member according to the present invention, such as the intermediate transfer member and the transfer-transport member, may preferably have a volume resistance of from $10^0$ Ω to $10^{12}$ Ω, and particularly preferably from 106 Ω to $10^{11}$ Ω.

The transfer member according to the present invention, such as the intermediate transfer member and the transfer-transport member, may also preferably have a surface resistance of from $10^0$ Ω to $10^{17}$ Ω, and particularly preferably from $10^6$ Ω to $10^{14}$ Ω.

In order to function as the transfer member (belt) of the present invention, it is also preferable to control the maximum values of volume resistance and surface resistance to be within 100 times their minimum values at every area of the belt.

In particular, the maximum value of volume resistance in the peripheral direction may preferably be within 100 times its minimum value. This is because, if the maximum value of volume resistance in the peripheral direction of the belt is greater than 100 times its minimum value, uneven transfer may occur in the peripheral direction, or, when voltage is applied at a plurality of spots, electric current may flow from some voltage-applied spots into other voltage-applied spots through areas having a low resistance in the peripheral direction, so that the disorder of voltage control at such other spots may make any normal operation impossible.

The maximum value of surface resistance in the peripheral direction may also preferably be within 100 times its minimum value. This is because, if the maximum value of surface resistance in the peripheral direction of the belt is greater than 100 times its minimum value, uneven transfer may occur in the peripheral direction, or, when voltage is applied at a plurality of spots, electric current may flow from some voltage-applied spots into other voltage-applied spots through areas having a low resistance in the peripheral direction, so that the disorder of voltage control at such other spots may make any normal operation impossible.

The maximum value of volume resistance in the generatrix direction may also preferably be within 100 times its minimum value. This is because, if the maximum value of volume resistance in the generatrix direction of the belt is greater than 100 times its minimum value, uneven transfer may occur in the generatrix direction, or excessive electric current may flow into portions having minimum resistance, bringing about a possibility of faulty operation of the apparatus.

The maximum value of surface resistance in the generatrix direction may also preferably be within 100 times its minimum value. This is because, if the maximum value of surface resistance in the generatrix direction of the belt is greater than 100 times its minimum value, uneven transfer may also occur in the generatrix direction, or, when a cleaning method is used in which stated electric charges are imparted to transfer residual toners to return them onto the photosensitive drum, excessive electric current may flow from the charge-providing charging member into the belt at its portions having minimum surface resistance, so that any sufficient electric field can not be applied to such areas in their generatrix direction, and hence uneven cleaning may occur in the generatrix direction.

In the present invention, the volume resistance and the surface resistance do not indicate mere difference in conditions of measurement, but indicate quite different electrical characteristics. That is, when voltage and current to be applied to the transfer member are applied in the thickness direction, the movement of electric charges in the transfer member is chiefly determined by the transfer member's internal structure and physical properties. As the result thereof, the surface potential, charge elimination rate and so forth of the transfer member are determined. On the other hand, when the voltage and current are so applied that electric charges are given and received only on the surface of the transfer member, charging and charge eliminating characteristics are determined only depending on the proportion of presence of additives or resistance control agents on the surface, almost without depending on the transfer member's internal structure an layer construction.

Hence, it is preferable for these volume resistance and surface resistance to be both brought into the above ranges, because good image quality can be achieved over the whole image areas, maintaining the transfer efficiency and the uniform transfer performance of the transfer member and without causing any defectives such as filming.

Figure 3:
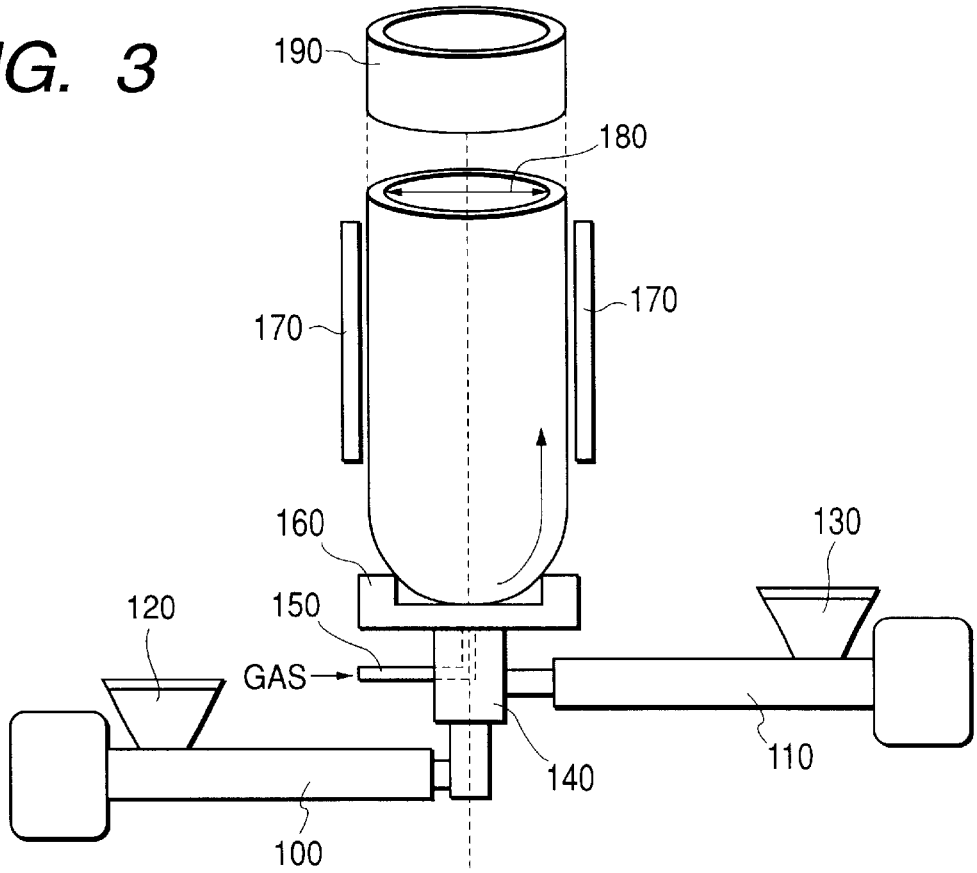
FIG. 3 is a schematic view of an example of an extruder.

An example of an apparatus for producing the transfer member of the present invention is shown in FIG. 3. This apparatus consists basically of an extruder and a circular die, and optionally a gas blowing unit. An example is by no means limited thereto.

The apparatus shown in FIG. 3 has two extruders 100 and 110 so that a belt of double-layer construction can be extruded. In the present invention, however, at least one extruder may be provided. A single-layer transfer member can be produced by a process described below.

First, an extrusion resin, a conducting agent, additives and so forth are premixed under the desired formulation and thereafter kneaded and dispersed to prepare an extrusion material, which is then put into a hopper 120 installed to the extruder 100. The extruder 100 has a preset temperature, extruder screw construction and so forth which have been so selected that the extrusion material may have a melt viscosity necessary for enabling the extrusion into a belt in the post step and also the constituent materials can be dispersed uniformly. Then, the extrusion material is melt-kneaded in the extruder 100 into a melt, which then enters a circular die 140, and is extruded therefrom at a prescribed extrusion ratio. The circular die 140 is provided with a gas inlet passage 150. Through the gas inlet passage 150, air is blown into the circular die 140, whereupon the melt having passed through the circular die 140 in a cylindrical form inflates while scaling up in the diametrical direction. Also, the melt may be extruded without blowing the air into the gas inlet passage 150.

The extruded product having thus inflated is drawn upward while being cooled by a cooling ring 160. At this stage, the extruded product passes through the space defined by a dimension stabilizing guide 170, so that its final shape dimension 180 is determined. This product is further cut in desired width, thus a transfer belt 190 of the present invention can be obtained.

The extrusion ratio referred to in the present invention is meant to be the ratio of the cylinder diameter corresponding to shape dimension 180 to the bore diameter of the circular die 140, the former being that after extrusion where the extrusion material has passed through the circular die and has inflated while scaling up in diameter.

More specifically, extrusion ratio=(cylindrical product diameter after extrusion)/(bore diameter of circular die).

The foregoing description concerns a single-layer belt. In the case of double-layer construction, an extruder 110 is further provided. Simultaneously with the kneaded melt in the extruder 100, a kneaded melt in the extruder 110 is sent to a double-layer circular die 140, and the two layers are simultaneously extruded and then scale-up inflated to obtain a double-layer belt. Reference numeral 130 denotes a hopper 130.

Of course, the belt may also be formed in triple- or more layers, and the extruder may be provided in the number corresponding to the number of layers.

The belt extruded may also preferably have a thickness smaller than the die gap of the circular die. This is because, when, e.g., a film of 150 $\mu$m thick is prepared under a die gap of 150 $\mu$m, an alteration of the die gap by 50 $\mu$m makes the film thickness change by 50 $\mu$m exactly but in fact it is difficult to adjust the die gap at intervals of 1 $\mu$m, so that films with uneven layer thickness tend to be formed. However, when, e.g., the film of 150 $\mu$m thick is prepared under a die gap of 1.5 mm, even a difference of the die gap by 50 $\mu$m makes the film finally have a layer thickness deflection of 1/10 and hence actually have a layer thickness deflection of 5 $\mu$m, so that films can finally be prepared in a high precision. Thus, the extruded belt may preferably have a thickness smaller than the die gap of the circular die.

As a method by which the extruded belt is made to have a thickness smaller than the die gap of the circular die, the film may be taken off at a speed higher than the ejection speed of the melt ejected through the circular die leading end in a tubular form by extrusion of the extruder. For example, where the melt to be extruded in a tubular form from the die leading end without film take-off is extruded at a speed of 1 m/min and the die has a bore diameter equal to the cylinder diameter of the film and also the take-off speed is 10 m/min, the film thickness comes to 1/10 of the die gap of the circular die, thus the extruded belt can be made to have a thickness smaller than the die gap of the circular die.

As another method by which the extruded belt is made to have a thickness smaller than the die gap of the circular die, the extrusion ratio may be set higher than 1. More specifically, by making the film diameter larger than the die diameter, the film thickness can be made small correspondingly to the film diameter made larger even when the take-off speed is equal to the extrusion speed. Here, the extrusion ratio may preferably be at a maximum value of 4.0 or lower. An extrusion ratio higher than that may make the inflated film have a poor stability, resulting in an unstable layer thickness in some cases.

The belt extruded can also be made to have a thickness smaller than the die gap of the circular die by making the take-off speed higher even at an extrusion ratio of 1 or less. This case is useful chiefly under such conditions that the resin has a low molecular weight at the time of extrusion.

More specifically, when the resin has a low viscosity at the time of kneading, holes may be made in the film if the extrusion ratio is set higher than 1. In such a case, the belt extruded can be made to have a thickness smaller than the die gap of the circular die by setting the extrusion ratio at 1 or lower. Here, the extrusion ratio may preferably be at a minimum value of 0.5 or higher. An extrusion ratio lower than 0.5 may make it necessary to make the film take-off speed greatly higher when the film is taken off, resulting in unstable extrusion in some cases.

As a method by which the extrusion ratio is made higher than 1, an extrusion method is available in which a gas having a pressure higher than atmospheric pressure is blown into the melt ejected through the circular die leading end in a tubular form by extrusion of the extruder, to cause the extruded product to inflate and at the same time carry out the extrusion continuously. In this case, the gas having a pressure higher than atmospheric pressure as blown into the tube causes the tube to inflate to make the extrusion ratio higher than 1. The gas to be blown here may be selected from, besides the air, nitrogen, carbon dioxide and argon, but without limitation thereto.

When cut in the desired width, the tubular film ejected by extrusion of the extruder from the circular die leading end may preferably continuously be cut in prescribed length in the direction perpendicular to its generatrix direction. This is because, when cut continuously, cutting in the state the cutter blade is stopped may produce a time difference between the beginning of cut and the finish of cut, so that the tubular film is obliquely cut, making it necessary for the cut film to be again cut when worked into the belt, thus the number of steps must be added. As a method by which the tubular film is continuously cut in the direction perpendicular to its generatrix direction, a cutter may be used which moves in the direction of extrusion at the same speed as the tube extrusion speed, but without limitation thereto.

The belt obtained after extrusion may preferably have a thickness in the range of from 45 to 300 $\mu$m, more preferably from 50 to 270 $\mu$m, and particularly preferably from 55 to 260 $\mu$m. In a thickness larger than 300 $\mu$m, when the belt having such a large thickness is used as a transfer belt, it may smoothly travel with difficulty because of a fairly high rigidity and a poor flexibility, to tend to cause deflection or torsion of the belt. In a thickness smaller than 45 $\mu$m, problems in practical use tend to occur such that the belt has a low tensile strength as the intermediate transfer member and the belt becomes loose during its long-stretch rotating service to cause elongation gradually.

In the production process of the present invention, the production of a belt with a thickness smaller than 45 $\mu$m enables achievement of stability in electrical resistance and can be dealt with. However, because of a thin layer such a belt is not suitable taking account of the above problems in practical use.

As the first image-bearing member, an electrophotographic photosensitive member containing fine particles of polytetrafluoroethylene in at least its outermost layer may preferably be used because a higher primary transfer efficiency can be achieved. This is presumably because the incorporation of fine particles of polytetrafluoroethylene lowers surface energy of the outermost layer of the electrophotographic photosensitive member to bring about an improvement in releasability of the toner.

EXAMPLES

The present invention is described below in greater detail by giving Examples. In the following, "part(s)" is by weight, unless particularly noted.

Example 1

Materials

| | |
|---|---|
| Polyvinylidene fluoride | 79 parts |
| Polyether-ester amide A (volume resistivity: $8 \times 10^8\ \Omega \cdot$ cm) | 21 parts |

Kneader and Kneading Conditions

Twin-screw extruder of 30 mm in diameter and same-direction rotating intermesh type.

Screw: Double-thread type; L/D=38.

Extrusion temperature: 210° C.

Extrusion conditions: Screw rotation, 200 rpm; ejection quantity, 15 kg/h.

A formulation of the above materials was mixed by means of a tumbling mixer, and thereafter the mixture obtained was kneaded by means of the above twin-screw extruder. The kneaded product obtained was further made into pellets of 2 to 3 mm diameter to obtain an extrusion material (1).

Extrusion

The extrusion material (1) was put into the hopper 120 of the single-screw extruder 100 shown in FIG. 3, and was extruded at a preset temperature regulated within the range of from 200 to 210° C., to form a melt. The melt was subsequently brought to a cylindrical single-layer extruding circular die 140 of 100 mm in die diameter and 1,200 $\mu$m in die gap. The melt ejected here from the die leading end was at an ejection rate of 1 m/min. Then, air was blown from the gas inlet passage 150 to scale-up inflate the extruded product into a tubular film while being taken off at a take-off speed of 5 m/min, in the course of which the tubular film was continuously cut at intervals of 230 mm in the direction perpendicular to its generatrix direction to produce belts. Here, the extrusion ratio was 1.6. As the result, an intermediate transfer member 190 was obtained which had as final shape dimensions a diameter of 160 mm and a thickness of 150 $\mu$m, a belt width of 230 mm. This belt is designated as intermediate transfer belt (1).

Evaluation

Figure 4:
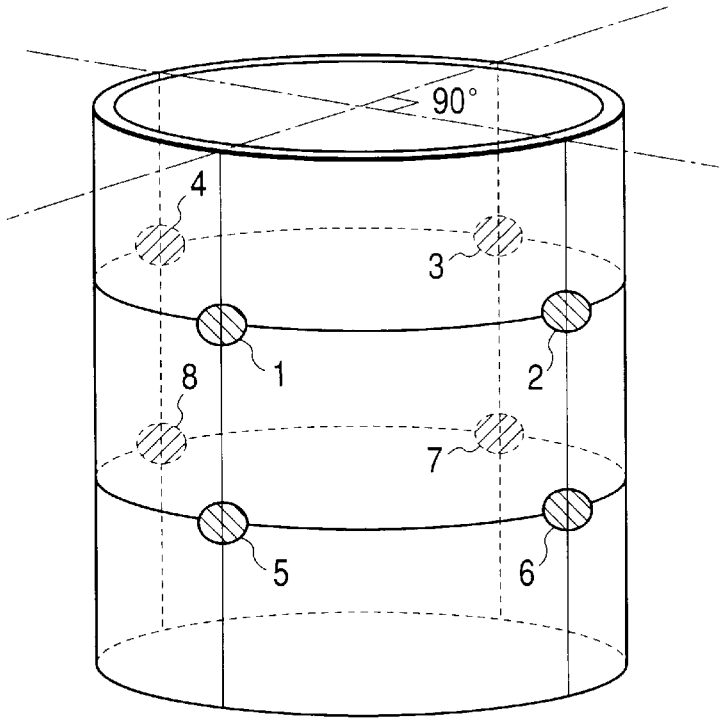
FIG. 4 illustrates an example of positions at which the electrical resistance is measured.

The volume resistance measured on the intermediate transfer belt (1) was $8\times10^7\ \Omega$ as the center value. The surface resistance measured thereon was $3.0\times10^8\ \Omega$ as the center value. Also, using the electrical resistance measuring instrument, a voltage of 100 V was applied to measure the electrical resistance of the intermediate transfer belt (1) at four spots in its peripheral direction and at two spots in its axial direction at each position of the former, eight spots in total, as shown in FIG. 4, and any scattering of volume resistance and surface resistance in the belt was examined. As the result, the scattering of measurements of resistance at the eight spots was kept within 8 times. A voltage of 500 V was further applied to measure the resistance, but any leak did not occur.

Scattering of measurement of thickness at the like positions was also within the range of 150 $\mu$m±10 $\mu$m, because the die gap was wider than the thickness of the belt formed and the layer thickness was controllable with ease. Upon visual observation of the intermediate transfer belt (1), none of foreign matter or faulty extrusion such as granular structure and fish eyes was seen on its surface.

This intermediate transfer belt (1) was set in the full-color electrophotographic apparatus shown in FIG. 1, and full-color images were printed on 80 g/m$^2$ paper to measure transfer efficiencies; the transfer efficiencies being defined as follows: Primary transfer efficiency (efficiency of transfer from electrophotographic photosensitive member to intermediate transfer belt)=(image density on intermediate transfer belt)/(transfer residual image density on electrophotographic photosensitive member+image density on intermediate transfer belt) Secondary transfer efficiency (efficiency of transfer from intermediate transfer belt to paper)=(image density on paper)/(image density on paper+transfer residual image density on intermediate transfer belt)

In the present Example, an organic electrophotographic photosensitive member the outermost layer of which contained polytetrafluoroethylene fine particles was used as the electrophotographic photosensitive member 1. Hence, a high primary transfer efficiency was attained. The primary transfer efficiency and the secondary transfer efficiency were 95% and 93%, respectively.

The intermediate transfer belt was cleaned by a cleaning-at-primary-transfer method in which an elastic roller having a resistance of $1\times10^8$ Ω was used as the charging member 7 for cleaning.

Using this belt, images were reproduced. As a result, good images were obtainable without causing any fine image unevenness which might occur when mutual spaces between polyether-ester amide portions were coarse, because the polyether-ester amide was added in an amount of 21% by weight or more, also causing neither blank areas caused by poor transfer nor faulty cleaning.

This intermediate transfer belt (1) further had an elastic modulus in tension of 790 MPa. Using this intermediate transfer belt (1), images were reproduced on 50,000 sheets. As a result, the belt caused neither cracking nor breaking, and was proved to be a belt having a durability.

In addition, when the kneading and extrusion were repeatedly carried out 10 times using the same formulation as that in the production of this belt, the fluctuation of volume resistance was within 5 times.

Example 2

Materials

| | |
|---|---|
| Polyvinylidene fluoride (melt viscosity at 210° C.: 4,500 Pa · s) | 69 parts |
| Polyether-ester amide B (melt viscosity at 210° C.: 400 Pa · s) | 15 parts |
| Polyether-ester amide C (melt viscosity at 210° C.: 2,000 Pa · s) | 16 parts |

Kneader and Kneading Conditions

The same kneader and kneading conditions as those in Example 1.

A formulation of the above materials was mixed by means of a tumbling mixer, and thereafter the mixture obtained was kneaded by means of the twin-screw extruder. The kneaded product obtained was further made into pellets of 2 to 3 mm diameter to obtain an extrusion material (2).

Extrusion

The extrusion material (2) was put into the hopper 120 of the single-screw extruder 100 shown in FIG. 3, and was extruded at a preset temperature regulated within the range of from 200 to 210° C., to form a melt. The melt had so low a melt viscosity that a method was used in which the extrusion ratio was set to be 1 or lower and the take-off speed was made higher so that the belt extruded had a thickness smaller than the die gap of the circular die.

The melt was brought to a cylindrical single-layer extruding circular die 140 of 200 mm in die diameter and 1,200 μm in die gap, of the die used. The melt ejected here from the die leading end was at an ejection rate of 1 m/min. Then, without blowing air into it from the gas inlet passage 150, the extruded product was constricted in a diameter smaller than the die diameter so as to be made into a tubular film while being taken off at a take-off speed of 10 m/min, in the course of which the tubular film was continuously cut at intervals of 230 mm in the direction perpendicular to its generatrix direction to produce belts. Here, the extrusion ratio was 0.8. As the result, an intermediate transfer belt 190 was obtained which had as final shape dimensions a diameter of 160 mm, a thickness of 150 μm and a belt width of 230 mm. This belt is designated as intermediate transfer belt (2).

Evaluation

The volume resistance measured on the intermediate transfer belt (2) was $3.5\times10^7$ Ω as the center value. The surface resistance measured thereon was $2.0\times10^8$ Ω as the center value. Also, using the electrical resistance measuring instrument, a voltage of 100 V was applied to measure the electrical resistance of the intermediate transfer belt (2) at four spots in its peripheral direction and at two spots in its axial direction at each position of the former, eight spots in total, as shown in FIG. 4, and any scattering of volume resistance and surface resistance in the belt was examined. As the result, the scattering of measurements of resistance at the eight spots was kept within 10 times. A voltage of 500 V was further applied to measure the resistance, but any leak did not occur.

Scattering of measurement of thickness at the like positions was also within the range of 150 μm±10 μm, because the die gap was wider than the thickness of the belt formed and the layer thickness was controllable with ease. This intermediate transfer belt (2) was set in the full-color electrophotographic apparatus shown in FIG. 1, and full-color images were printed on 80 g/m$^2$ paper to measure transfer efficiencies.

In the present Example, an organic electrophotographic photosensitive member the outermost layer of which contained polytetrafluoroethylene fine particles was used as the electrophotographic photosensitive member 1. Hence, a high primary transfer efficiency was attained. The primary transfer efficiency and the secondary transfer efficiency were 95% and 92%, respectively.

The intermediate transfer belt was cleaned by a cleaning-at-primary-transfer method in which an elastic roller having a resistance of $1\times10^8$ Ω was used as the charging member 7 for cleaning.

Using this belt, images were reproduced. As a result, good images were obtainable without causing any fine image unevenness which might occur when mutual spaces between polyether-ester amide portions were coarse, because the polyether-ester amide was added in an amount of 21% by weight or more, also causing neither blank areas caused by poor transfer nor faulty cleaning.

This intermediate transfer belt (2) further had an elastic modulus in tension of 1,100 MPa. Using this intermediate transfer belt (2), images were reproduced on 100,000 sheets. As a result, the belt caused neither cracking nor breaking, and was proved to be a belt having a higher durability than in Example 1.

In addition, when the kneading and extrusion were repeatedly carried out 10 times under the same formulation as that in the production of this belt, the fluctuation of volume resistance was within 5 times.

Example 3

Materials

| | |
|---|---|
| Polyvinylidene fluoride | 77 parts |
| Polyether-ester amide D (volume resistivity: $3.0\times10^8$ Ω · cm) | 10 parts |
| Polyether-ester amide E (volume resistivity: $7.0\times10^9$ Ω · cm) | 13 parts |

Kneader and Kneading Conditions

The same kneader and kneading conditions as those in Example 1.

A formulation of the above materials was mixed by means of a tumbling mixer, and thereafter the mixture obtained was kneaded by means of the twin-screw extruder. The kneaded product obtained was further made into pellets of 2 to 3 mm diameter to obtain an extrusion material (3).

Extrusion

The extrusion material (3) was put into the hopper 120 of the single-screw extruder 100 shown in FIG. 3, and was extruded at a preset temperature regulated within the range of from 200 to 210° C., to form a melt. The melt had so low a melt viscosity that a method was used in which the extrusion ratio was set to be 1 or lower and the take-off speed was made higher so that the belt extruded had a thickness smaller than the die gap of the circular die.

The melt was brought to a cylindrical single-layer extruding circular die 140 of 200 mm in die diameter and 1,200 $\mu$m in die gap, of the die used. The melt ejected here from the die leading end was at an ejection rate of 1 m/min. Then, without blowing air into it from the gas inlet passage 150, the extruded product was constricted in a diameter smaller than the die diameter so as to be made into a tubular film while being taken off at a take-off speed of 10 m/min, in the course of which the tubular film was continuously cut at intervals of 230 mm in the direction perpendicular to its generatrix direction to produce belts. Here, the extrusion ratio was 0.8. As the result, an intermediate transfer belt 190 was obtained which had as final shape dimensions a diameter of 160 mm, a thickness of 150 $\mu$m and a belt width of 230 mm. This belt is designated as intermediate transfer belt (3).

Evaluation

The volume resistance measured on the intermediate transfer belt (3) was $2.0\times10^8$ Ω as the center value. The surface resistance measured thereon was $2.5\times10^9$ Ω as the center value. Also, using the electrical resistance measuring instrument, a voltage of 100 V was applied to measure the electrical resistance of the intermediate transfer belt (3) at four spots in its peripheral direction and at two spots in its axial direction at each position of the former, eight spots in total, as shown in FIG. 4, and any scattering of volume resistance and surface resistance in the belt was examined. As the result, the scattering of measurements of resistance at the eight spots was kept within 5 times. A voltage of 500 V was further applied to measure the resistance, but any leak did not occur.

Scattering of measurement of thickness at the like positions was also within the range of 150 $\mu$m±10 $\mu$m, because the die gap was wider than the thickness of the belt formed and the layer thickness was controllable with ease. This intermediate transfer belt (3) was set in the full-color electrophotographic apparatus shown in FIG. 1, and full-color images were printed on 80 g/m$^2$ paper to measure transfer efficiencies.

In the present Example, an organic electrophotographic photosensitive member the outermost layer of which contained polytetrafluoroethylene fine particles was used as the electrophotographic photosensitive member 1. Hence, a high primary transfer efficiency was attained. The primary transfer efficiency and the secondary transfer efficiency were 95% and 93%, respectively.

The intermediate transfer belt was cleaned by a cleaning-at-primary-transfer method in which an elastic roller having a resistance of $1\times10^8$ Ω was used as the charging member 7 for cleaning.

Using this belt, images were reproduced. As a result, good images were obtainable without causing any fine image unevenness which might occur when mutual spaces between polyether-ester amide portions were coarse, because the polyether-ester amide was added in an amount of 21% by weight or more, also causing neither blank areas caused by poor transfer nor faulty cleaning.

This intermediate transfer belt (3) further had an elastic modulus in tension of 820 MPa. Using this intermediate transfer belt (3), images were reproduced on 50,000 sheets. As a result, the belt caused neither cracking nor breaking, and was proved to be a belt having durability.

In addition, when the kneading and extrusion were repeatedly carried out 10 times under the same formulation as that in the production of this belt, the fluctuation of volume resistance was within 3 times, bringing about much higher production stability than that in Example 1.

Example 4

Materials

| | |
|---|---|
| Polyvinylidene fluoride | 79 parts |
| Polyether-ester amide F (volume resistivity: $5\times10^9$ Ω · cm) | 21 parts |

Kneader and Kneading Conditions

The same kneader and kneading conditions as those in Example 1.

A formulation of the above materials was mixed by means of a tumbling mixer, and thereafter the mixture obtained was kneaded by means of the above twin-screw extruder. The kneaded product obtained was further made into pellets of 2 to 3 mm diameter to obtain an extrusion material (4).

Extrusion

The extrusion material (4) was put into the hopper 120 of the single-screw extruder 100 shown in FIG. 3, and was extruded at a preset temperature regulated within the range of from 200 to 210° C., to form a melt. The melt was subsequently brought to a cylindrical single-layer extruding circular die 140 of 200 mm in die diameter and 1,200 $\mu$m in die gap. The melt ejected here from the die leading end was at an ejection rate of 1 m/min. Then, air was blown from the gas inlet passage 150 to scale-up inflate the extruded product into a tubular film while being taken off at a take-off speed of 4.5 m/min, in the course of which the tubular film was continuously cut at intervals of 310 mm in the direction perpendicular to its generatrix direction to produce belts. Here, the extrusion ratio was 1.775. As the result, a transfer-transport belt 190 was obtained which had as final shape dimensions a diameter of 355 mm and a thickness of 150 $\mu$m, a belt width of 310 mm. This belt is designated as transfer-transport belt (1).

Evaluation

The volume resistance measured on the transfer-transport belt (1) was $7.0\times10^9$ Ω as the center value. The surface resistance measured thereon was $3.0\times10^{10}$ Ω as the center value. Also, using the electrical resistance measuring instrument, a voltage of 100 V was applied to measure the electrical resistance of the transfer-transport belt (1) at four spots in its peripheral direction and at two spots in its axial direction at each position of the former, eight spots in total, as shown in FIG. 4, and any scattering of volume resistance and surface resistance in the belt was examined. As the result, the scattering of measurements of resistance at the eight spots was kept within 10 times. A voltage of 500 V was further applied to measure the resistance, but any leak did not occur.

Scattering of measurement of thickness at the like positions was also within the range of 150 $\mu$m±10 $\mu$m, because the die gap was wider than the thickness of the belt formed and the layer thickness was controllable with ease. Upon visual observation of the transfer-transport belt (1), none of foreign matter or faulty extrusion such as granular structure and fish eyes was seen on its surface.

Figure 2:
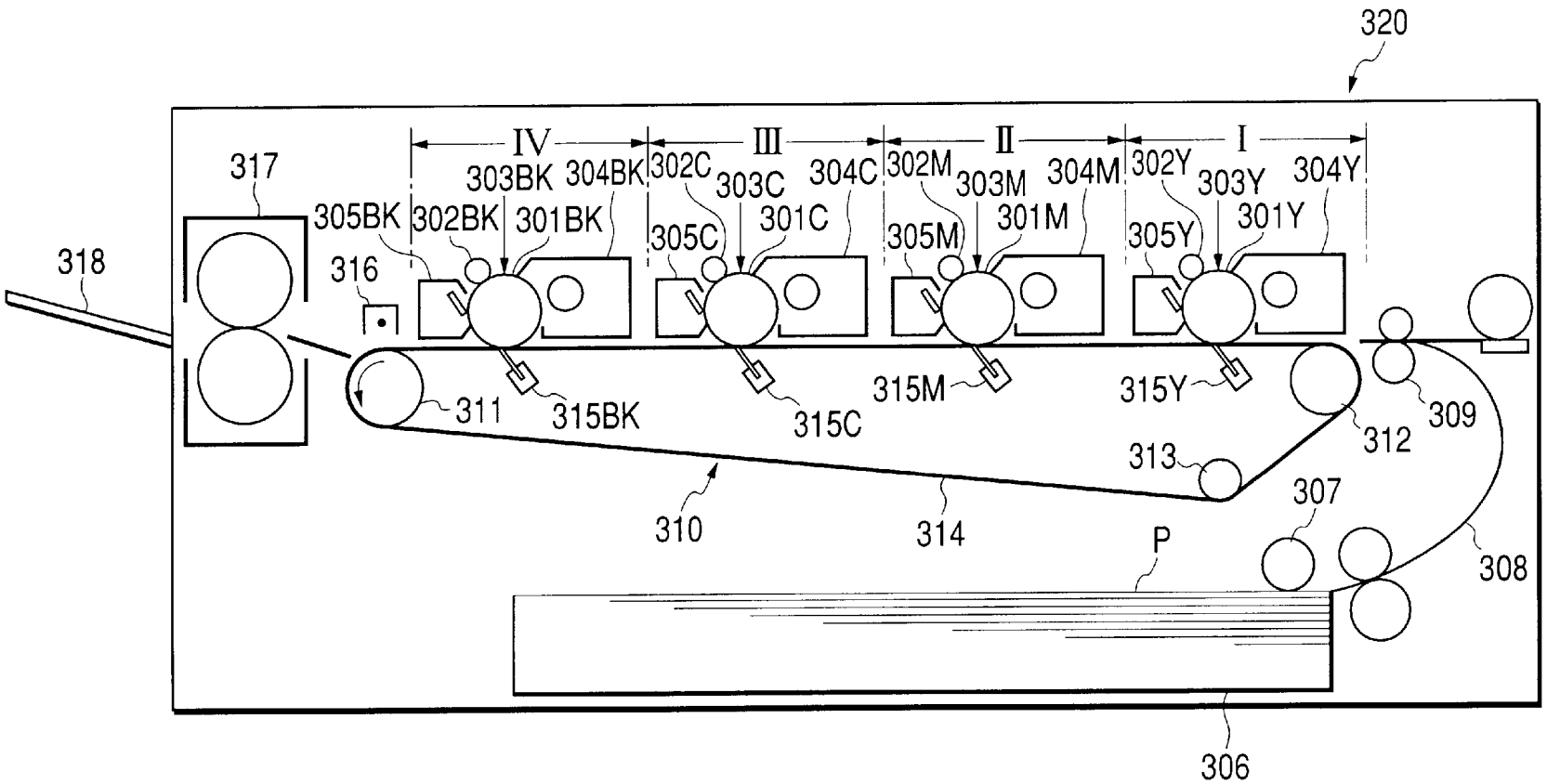
FIG. 2 is a schematic view of an example of an image-forming apparatus employing a transfer-transport member.

This transfer-transport belt (1) was set in the full-color electrophotographic apparatus shown in FIG. 2, and images were reproduced. As a result, good images were obtainable without causing any fine image unevenness which might occur when mutual spaces between polyether-ester amide portions were coarse, because the polyether-ester amide was added in an amount of 21% by weight or more, also causing neither blank areas caused by poor transfer nor faulty cleaning.

This transfer-transport belt (1) further had an elastic modulus in tension of 850 MPa. Using this transfer-transport belt (1), images were reproduced on 50,000 sheets. As a result, the belt caused neither cracking nor breaking, and was proved to be a belt having durability.

In addition, when the kneading and extrusion were repeatedly carried out 10 times under the same formulation as that in the production of this belt, the fluctuation of volume resistance was within 5 times.

Comparative Example 1

Materials

| | |
|---|---|
| Polyvinylidene fluoride | 85 parts |
| Polyether-ester amide A | 15 parts |

Kneader and Kneading Conditions

The same kneader and kneading conditions as those in Example 1.

A formulation of the above materials was mixed by means of a tumbling mixer, and thereafter the mixture obtained was kneaded by means of the above twin-screw extruder. The kneaded product obtained was further made into pellets of 2 to 3 mm diameter to obtain an extrusion material (5).

Extrusion

The extrusion material (5) was put into the hopper 120 of the single-screw extruder 100 shown in FIG. 3, and was extruded at a preset temperature regulated within the range of from 200 to 210° C., to form a melt. The melt was subsequently brought to a cylindrical single-layer extruding circular die 140 of 160 mm in die diameter and 150 $\mu$m in die gap. The melt ejected here from the die leading end was at an ejection rate of 1 m/min. Then, the extruded product was formed into a tubular film while being taken off at a take-off speed of 1 m/min, in the course of which the tubular film was continuously cut at intervals of 230 mm in the direction perpendicular to its generatrix direction to produce belts. Here, the extrusion ratio was 1.0. As the result, an intermediate transfer belt 190 was obtained which had as final shape dimensions a diameter of 160 mm and a thickness of 150 $\mu$m, a belt width of 230 mm. This belt is designated as intermediate transfer belt (4).

Evaluation

The volume resistance measured on the intermediate transfer belt (4) was $4.0\times10^{9}$ Ω as the center value. The surface resistance measured thereon was $8.0\times10^{10}$ Ω as the center value. Also, using the electrical resistance measuring instrument, a voltage of 100 V was applied to measure the electrical resistance of the intermediate transfer belt (4) at four spots in its peripheral direction and at two spots in its axial direction at each position of the former, eight spots in total, as shown in FIG. 4, and any scattering of volume resistance and surface resistance in the belt was examined. As the result, the scattering of measurements of resistance at the eight spots was 100 times. This was presumed to be due to the fact that the scattering of measurement of thickness at the like positions was within the range of 150 $\mu$m±50 $\mu$m because the thickness of the belt formed was identical to the die gap width and the layer thickness was controllable with difficulty. A voltage of 500 V was further applied to measure the resistance, but any leak did not occur.

In the present Example, an organic electrophotographic photosensitive member the outermost layer of which contained polytetrafluoroethylene fine particles was used as the electrophotographic photosensitive member 1. Hence, a high primary transfer efficiency was attained. The primary transfer efficiency and the secondary transfer efficiency were 95% and 93%, respectively.

The intermediate transfer belt was cleaned by a cleaning-at-primary-transfer method in which an elastic roller having a resistance of $1\times10^{8}$ Ω was used as the charging member 7 for cleaning.

This intermediate transfer belt (4) was set in the full-color electrophotographic apparatus shown in FIG. 1, and images were reproduced, but the fine image unevenness occurred because the polyether-ester amide was in an amount of 15% by weight, which made mutual spaces between polyether-ester amide portions coarse. The transfer efficiency was also measured, but the scattering of resistance measured was so great that transfer efficiency was 91% at the highest areas and 88% at the lowest areas, and images had much transfer unevenness, showing an insufficient transfer efficiency.

Since the fine image unevenness occurred, the running test was not made.

Comparative Example 2

Materials

| | |
|---|---|
| Polyvinylidene fluoride | 88 parts |
| Polyether-ester amide A | 12 parts |

Kneader and Kneading Conditions

The same kneader and kneading conditions as those in Example 1.

A formulation of the above materials was mixed by means of a tumbling mixer, and thereafter the mixture obtained was kneaded by means of the above twin-screw extruder. The kneaded product obtained was further made into pellets of 2 to 3 mm diameter to obtain an extrusion material (6).

Extrusion

The extrusion material (6) was put into the hopper 120 of the single-screw extruder 100 shown in FIG. 3, and was extruded at a preset temperature regulated within the range of from 200 to 210° C., to form a melt. The melt was subsequently brought to a cylindrical single-layer extruding circular die 140 of 200 mm in die diameter and 1,200 $\mu$m in die gap. The melt ejected here from the die leading end was at an ejection rate of 1 m/min. Then, air was blown from the gas inlet passage 150 to scale-up inflate the extruded product into a tubular film while being taken off at a take-off speed of 4.5 m/min, in the course of which the tubular film was continuously cut at intervals of 310 mm in the direction perpendicular to its generatrix direction to produce belts. Here, the extrusion ratio was 1.775. As the result, a transfer-transport belt 190 was obtained which had as final shape dimensions a diameter of 355 mm and a thickness of 150 $\mu$m, a belt width of 310 mm. This belt is designated as transfer-transport belt (2).

Evaluation

The volume resistance measured on the transfer-transport belt (2) was $2.5\times10^{10}$ Ω as the center value. The surface resistance measured thereon was $7.0\times10^{11}$ Ω as the center value. Also, using the electrical resistance measuring instrument, a voltage of 100 V was applied to measure the electrical resistance of the transfer-transport belt (2) at four spots in its peripheral direction and at two spots in its axial direction at each position of the former, eight spots in total, as shown in FIG. 4, and any scattering of volume resistance and surface resistance in the belt was examined. As the result, the scattering of measurements of resistance at the eight spots was 500 times. The scattering of measurement of thickness at the like positions was within the range of 150 μm±10 μm, because the die gap was wider than the thickness of the belt formed and the layer thickness was controllable with ease.

This transfer-transport belt (2) was set in the full-color electrophotographic apparatus shown in FIG. 2, and full-color images were printed on 80 g/m$^2$ paper, but the fine image unevenness occurred because the polyether-ester amide was in an amount of 12% by weight, which made mutual spaces between polyether-ester amide portions coarse. The transfer efficiency was also measured, but the scattering of resistance measured was so great that transfer efficiency was 91% at the highest areas and 83% at the lowest areas, and images had much transfer unevenness, showing an insufficient transfer efficiency.

Since the fine image unevenness occurred, the running test was not made.

Comparative Example 3

Materials

| | |
|---|---|
| Polyvinylidene fluoride | 50 parts |
| Polyether-ester amide A | 50 parts |

Kneader and Kneading Conditions

The same as those in Example 1.

A kneaded product (pellets) was obtained in the same manner as in Example 1.

Extrusion

The kneaded product was put into the hopper 120 of the single-screw extruder 100 shown in FIG. 3, and was extruded at a preset temperature regulated within the range of from 200 to 210° C., to form a melt. The melt was subsequently brought to a cylindrical single-layer extruding circular die 140 of 160 mm in die diameter and 150 μm in die gap. The melt ejected here from the die leading end was at an ejection rate of 1 m/min. Then, the extruded product was formed into a tubular film while being taken off at a take-off speed of 1 m/min, in the course of which the tubular film was continuously cut at intervals of 230 mm in the direction perpendicular to its lengthwise direction to produce belts. Here, the extrusion ratio was 1.0. As the result, an intermediate transfer belt 190 was obtained which had as final shape dimensions a diameter of 160 mm and a thickness of 150 μm, a belt width of 230 mm. This belt is designated as intermediate transfer belt (6).

Evaluation

The volume resistance measured on the intermediate transfer belt (6) was $1.0\times10^{7}$ Ω as the center value. The surface resistance measured thereon was $2.0\times10^{8}$ Ω as the center value. Also, using the electrical resistance measuring instrument, a voltage of 100 V was applied to measure the electrical resistance of the intermediate transfer belt (6) at four spots in its peripheral direction and at two spots in its axial direction at each position of the former, eight spots in total, as shown in FIG. 4, and any scattering of volume resistance and surface resistance in the belt was examined. As the result, the scattering of measurements of resistance at the eight spots was 100 times. This was presumed to be due to the fact that the scattering of measurement of thickness at the like positions was within the range of 150 μm±50 μm because the thickness of the belt formed was identical to the die gap width and the layer thickness was controllable with difficulty. A voltage of 500 V was further applied to measure the resistance, and a leak occurred.

In the present Example, an organic electrophotographic photosensitive member the outermost layer of which contained polytetrafluoroethylene fine particles was used as the electrophotographic photosensitive member 1. However, since the polyether-ester amide was in an amount more than 40% by weight, the belt had too low a resistance to provide a sufficient transfer electric field, resulting in a low transfer efficiency. The primary transfer efficiency and the secondary transfer efficiency were 85% and 70%, respectively.

The intermediate transfer belt was cleaned by a cleaning-at-primary-transfer method in which an elastic roller having a resistance of $1\times10^{8}$ Ω was used as the charging member 7 for cleaning.

Using this belt (6), images were reproduced. As a result, any fine image unevenness did not occur because the polyether-ester amide was in an amount of 50% by weight, which made mutual spaces between polyether-ester amide portions dense, but a low transfer efficiency resulted as stated above, and the belt was a belt having no sufficient performance.

Since the transfer efficiency was low, the running test was not made.

Comparative Example 4

Materials

| | |
|---|---|
| Polyvinylidene fluoride | 55 parts |
| Polyether-ester amide A | 45 parts |

Kneader and Kneading Conditions

The same as those in Example 1.

A kneaded product (pellets) was obtained in the same manner as in Example 1.

Extrusion

The kneaded product was put into the hopper 120 of the single-screw extruder 100 shown in FIG. 3, and was extruded at a preset temperature regulated within the range of from 200 to 210° C., to form a melt. The melt was subsequently brought to a cylindrical single-layer extruding circular die 140 of 200 mm in die diameter and 1,200 μm in die gap. The melt ejected here from the die leading end was at an ejection rate of 1 m/min. Then, air was blown from the gas inlet passage 150 to scale-up inflate the extruded product into a tubular film while being taken off at a take-off speed of 4.5 m/min, in the course of which the tubular film was continuously cut at intervals of 310 mm in the direction perpendicular to its lengthwise direction to produce belts. Here, the extrusion ratio was 1.55. As the result, a transfer-transport belt 190 was obtained which had as final shape dimensions a diameter of 355 mm and a thickness of 150 μm, a belt width of 310 mm. This belt is designated as transfer-transport belt (3).

Evaluation

The volume resistance measured on the transfer-transport belt (3) was $2.5\times10^{7}$ Ω as the center value. The surface resistance measured thereon was $4.0\times10^{8}$ Ω as the center value. Also, using the electrical resistance measuring instrument, a voltage of 100 V was applied to measure the electrical resistance of the transfer-transport belt (3) at four spots in its peripheral direction and at two spots in its axial direction at each position of the former, eight spots in total, as shown in FIG. 4, and any scattering of volume resistance and surface resistance in the belt was examined. As the result, the scattering of measurements of resistance at the eight spots was 50 times. The scattering of measurement of thickness at the like positions was within the range of 150 $\mu$m±10 $\mu$m, because the die gap was wider than the thickness of the belt formed and the layer thickness was controllable with ease.

This transfer-transport belt (3) was set in the full-color electrophotographic apparatus shown in FIG. 2, and full-color images were printed on 80 g/m$^2$ paper. As a result, any fine image unevenness did not occur because the polyether-ester amide was in an amount of 45% by weight, which made mutual spaces between polyether-ester amide portions dense, but, since the polyether-ester amide was in an amount more than 40% by weight, the belt had too low a resistance to provide a sufficient transfer electric field, resulting in a low transfer efficiency. The transfer efficiency were 70%.

Since the transfer efficiency was low, the running test was not made.

As described above, according to the present invention, a high-quality intermediate transfer member and transfer member can be obtained which may cause no fine image unevenness at the time of transfer.

What is claimed is:

1. A transfer member comprising a resin layer, wherein said resin layer contains a thermoplastic resin and a polyether-ester amide, and the thermoplastic resin and the polyether-ester amide are in a weight ratio of from 79:21 to 60:40, wherein (i) said transfer member is a transfer belt having a thickness from 45 to 300 $\mu$m;

(ii) the maximum value of volume resistance in the peripheral direction of the transfer member is within 100 times its minimum value;

(iii) the maximum value of surface resistance in the peripheral direction of the transfer member is within 100 times its minimum value;

(iv) the maximum value of volume resistance in the generatrix direction of the transfer member is within 100 times its minimum value; and (v) the maximum value of surface resistance in the generatrix direction of the transfer member is within 100 times its minimum value.

2. The transfer member according to claim 1, wherein said polyether-ester amide comprises two or more types of polyether-ester amides having different melt viscosities.

3. The transfer member according to claim 1, wherein said polyether-ester amide comprises two or more types of polyether-ester amides having different volume resistivities.

4. The transfer member according to claim 1, which has a volume resistance of from $10^0$ Ω to $10^{12}$ Ω.

5. The transfer member according to claim 1, which has a surface resistance of from $10^0$ Ω to $10^{17}$ Ω.

6. The transfer member according to claim 1, which is an intermediate transfer member to which an image formed on a first image-bearing member is transferred and from which the image is thereafter further transferred to a second image-bearing member.

7. The transfer member according to claim 1, which is a transfer-transport member which is transported in contact with a plurality of image-bearing members and serves to transport a transfer medium to which images having different colors formed on the plurality of image-bearing members are sequentially transferred.

8. An image-forming apparatus comprising a transfer member, wherein said transfer member has at least a resin layer, and the resin layer contains a thermoplastic resin and a polyether-ester amide; the thermoplastic resin and the polyether-ester amide being in a weight ratio of from 79:21 to 60:40, wherein (i) said transfer member is a transfer belt having a thickness from 45 to 300 $\mu$m;

(ii) the maximum value of volume resistance in the peripheral direction of the transfer member is within 100 times its minimum value;

(iii) the maximum value of surface resistance in the peripheral direction of the transfer member is within 100 times its minimum value;

(iv) the maximum value of volume resistance in the generatrix direction of the transfer member is within 100 times its minimum value; and (v) the maximum value of surface resistance in the generatrix direction of the transfer member is within 100 times its minimum value.

9. The image-forming apparatus according to claim 8, wherein said transfer member is an intermediate transfer member to which an image formed on a first image-bearing member is transferred and from which the image is thereafter further transferred to a second image-bearing member.

10. The image-forming apparatus according to claim 9, wherein said intermediate transfer member is a transfer-transport member which is transported in contact with a plurality of image-bearing members and serves to transport a transfer medium to which images having different colors formed on the plurality of image-bearing members are sequentially transferred.

* * * * *